US009745157B2

(12) United States Patent
Zeng et al.

(10) Patent No.: US 9,745,157 B2
(45) Date of Patent: Aug. 29, 2017

(54) BANKNOTE CASSETTE AND BANKNOTE SIZE ADJUSTMENT DEVICE THEREOF

(71) Applicant: GRG BANKING EQUIPMENT CO., LTD., Guangzhou, Guangdong (CN)

(72) Inventors: Xiaogang Zeng, Guangdong (CN); Qiuhua Weng, Guangdong (CN); Dong Tan, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/328,373

(22) PCT Filed: Aug. 5, 2015

(86) PCT No.: PCT/CN2015/086132

§ 371 (c)(1),
(2) Date: Jan. 23, 2017

(87) PCT Pub. No.: WO2016/019870

PCT Pub. Date: Feb. 11, 2016

(65) Prior Publication Data

US 2017/0213410 A1 Jul. 27, 2017

(30) Foreign Application Priority Data

Aug. 8, 2014 (CN) ..... 2014 1 0390900

(51) Int. Cl.
*B65H 3/44* (2006.01)
*B65H 5/26* (2006.01)
(Continued)

(52) U.S. Cl.
CPC ..... *B65H 1/28* (2013.01); *B65H 1/02* (2013.01); *B65H 1/04* (2013.01); *B65H 31/20* (2013.01);
(Continued)

(58) Field of Classification Search
CPC . B65H 1/02; B65H 1/027; B65H 1/04; B65H 1/28; B65H 31/20;
(Continued)

(56) References Cited

U.S. PATENT DOCUMENTS 4,512,263 A * 4/1985 Lanning ..... B65H 31/14 109/24.1
4,704,061 A 11/1987 Peebles
(Continued)

FOREIGN PATENT DOCUMENTS

CN 1636849 A 7/2005
CN 1689051 A 10/2005
(Continued)

OTHER PUBLICATIONS

International Search Report for PCT/CN2015/086132, mailed Nov. 24, 2015, ISA/CN.

*Primary Examiner* — Prasad Gokhale
(74) *Attorney, Agent, or Firm* — U.S. Fairsky LLP; Yue Xu

(57) ABSTRACT

A banknote size adjustment device includes a pair of assemblies cooperating with each other to form a space for accommodating banknotes, the size of the space being adjustable; and front and rear support frames. Each assembly includes a position-limiting plate, a reinforcing plate, a pair of latch plates and a pair of compression springs, the reinforcing plate is fixed to a bottom of the position-limiting plate, and the latch plate is arranged at one end of the position-limiting plate and the reinforcing plate and is sandwiched between the position-limiting plate and the reinforcing plate, the compression spring has one end fixed to the reinforcing plate or the position-limiting plate and another end connected to one end of the latch plate, and applies an elastic force to the latch plate, to allow another
(Continued)

end of the latch plate to always maintain a tendency of being inserted into the positioning holes.

12 Claims, 5 Drawing Sheets

(51) Int. Cl.

| | |
|---|---|
| ***B65H 1/28*** | (2006.01) |
| ***G07D 11/00*** | (2006.01) |
| ***B65H 31/20*** | (2006.01) |
| ***B65H 1/04*** | (2006.01) |
| ***B65H 1/02*** | (2006.01) |

(52) U.S. Cl.
CPC .. *G07D 11/0006* (2013.01); *B65H 2405/1116* (2013.01); *B65H 2405/331* (2013.01); *B65H 2511/10* (2013.01); *B65H 2511/11* (2013.01); *B65H 2511/12* (2013.01); *B65H 2701/1912* (2013.01)

(58) Field of Classification Search
CPC .... B65H 2405/1116; B65H 2405/1122; B65H 2405/1134; B65H 2405/1144; B65H 2405/212; B65H 2405/214; B65H 2405/331; B65H 2511/10; B65H 2511/11; B65H 2511/12; B65H 2701/1912; G07D 11/0006
See application file for complete search history.

(56) References Cited

U.S. PATENT DOCUMENTS

| | | | | |
|---|---|---|---|---|
| 2005/0184444 | A1 | 8/2005 | An | |
| 2006/0157916 | A1 | 7/2006 | Ahn et al. | |
| 2008/0224388 | A1 | 9/2008 | Kim et al. | |
| 2009/0295073 | A1 | 12/2009 | Furusawa | |
| 2012/0255829 | A1* | 10/2012 | Togiya ..... | B65H 1/266 194/206 |
| 2013/0026178 | A1 | 1/2013 | Peters et al. | |
| 2015/0356807 | A1* | 12/2015 | Wakabayashi ..... | G07D 11/0012 194/350 |

FOREIGN PATENT DOCUMENTS

| | | | |
|---|---|---|---|
| CN | 2938241 | Y | 8/2007 |
| CN | 101266424 | A | 9/2008 |
| CN | 101350117 | A | 1/2009 |
| CN | 201181493 | Y | 1/2009 |
| CN | 101894417 | A | 11/2010 |
| CN | 102999970 | A | 3/2013 |
| CN | 203285811 | U | 11/2013 |
| CN | 104103125 | A | 10/2014 |
| JP | H05338819 | A | 12/1993 |
| JP | 2009286573 | A | 12/2009 |
| WO | 2004001686 | A2 | 12/2003 |

* cited by examiner

BANKNOTE CASSETTE AND BANKNOTE SIZE ADJUSTMENT DEVICE THEREOF

This application is the national phase of International Application No. PCT/CN2015/086132, titled "BANKNOTE CASSETTE AND BANKNOTE SIZE ADJUSTMENT DEVICE THEREOF", filed on Aug. 5, 2015, which claims the benefit of priority to Chinese patent application No. 201410390900.1, titled "BANKNOTE BOX AND BANKNOTE SIZE ADJUSTMENT DEVICE THEREOF", filed with the Chinese State Intellectual Property Office on Aug. 8, 2014, the entire disclosures of which are incorporated herein by reference.

FIELD

The present application relates to banknote processing technologies, and particularly relates to a banknote box and a banknote size adjustment device adjusting according to a length and a width of a banknote.

BACKGROUND

With the continuous development of the economy, the banknote processing load continuously increases, and the requirement for processing capacity of banknote processing apparatuses is improved accordingly. Currently, banknote processing apparatuses generally used have main functions such as an automatic banknote depositing and withdrawing machine, a dispenser. In banknote boxes of these apparatuses, banknote size adjustment devices are widely used. The banknote size adjustment device is a structure configured to adjust the size of a space for containing banknotes in a banknote box according to a length dimension and a width dimension of the banknotes. When banknotes of a certain size are deposited in a banknote box, the banknote size adjustment device adjusts the size of the space for containing the banknotes in the banknote box to be exactly adapted to the size of the banknotes, to allow the banknotes to be stacked tidily and orderly, rather than being folded or scattered. Therefore, the banknote size adjustment device is an indispensable structure in the banknote box.

The banknote size adjustment devices currently used have generally an issue that the adjustment is complicated and inconvenient. In a conventional banknote size adjustment method for a banknote box, an operator needs to loosen numerals screws first, and then separately move a position-limiting plate for a length dimension and a position-limiting plate for a width dimension, to align the position-limiting plates with respect to scale lines by eye survey, and then lock the screws to fix the position of the position-limiting plates. The operation is troublesome, and is apt to cause inaccuracy size adjustment.

SUMMARY

For addressing the issue in the conventional technology that the adjustment operation manner of the banknote size adjustment device is complicated and inconvenient, a banknote size adjustment device is provided according to the present application, to allow the banknote size adjustment in the banknote box to be simple and easy.

A banknote box is further provided according to the present application, which includes the above banknote size adjustment device.

The banknote size adjustment device is configured to be arranged in a banknote box and includes:

a pair of assemblies cooperating with each other to form a space for accommodating banknotes, a size of the space for accommodating banknotes being adjustable;

a front support frame and a rear support frame, wherein corresponding transverse scales and corresponding longitudinal scales are provided on the front support frame and the rear support frame, and a plurality of positioning holes corresponding to the transverse scales and the longitudinal scales are provided in the front support frame and the rear support frame, the front support frame and the rear support frame are configured to be fixed to an inner front wall and an inner rear wall of the banknote box respectively and configured to support the pair of assemblies;

wherein each of the assemblies includes a position-limiting plate, a reinforcing plate, a pair of latch plates and a pair of compression springs, the reinforcing plate is fixed to a bottom of the position-limiting plate, and one of the latch plates is arranged at one end of the position-limiting plate and the reinforcing plate and is sandwiched between the position-limiting plate and the reinforcing plate, one of the compression springs has one end fixed to the reinforcing plate or the position-limiting plate and another end connected to one end of the one of the latch plates, and is configured to apply an elastic force to the one of the latch plates, to allow another end of the one of the latch plates to always maintain a tendency of being inserted into the positioning holes, and the other one of the latch plates is arranged at another end of the position-limiting plate and the reinforcing plate symmetrically with respect to the one of the latch plates, and the other one of the compression springs is arranged at the another end of the position-limiting plate and the reinforcing plate symmetrically with respect to the one of the compression springs, and the assembly is positioned on the front support frame and the rear support frame by the pair of latch plates.

Preferably, the position-limiting plate has an L-shaped cross section, and the pair of assemblies are arranged to face each other, and the two position-limiting plates face each other to form a space enclosed on three sides for accommodating banknotes.

Preferably, each of the latch plates is provided with a pair of guide grooves, and the position-limiting plate or the reinforcing plate is provided with a pair of guide cylinders corresponding to the guide grooves, and the pair of guide cylinders protrude into the pair of guide grooves respectively, to limit an inserting-withdrawing direction of the latch plate.

Preferably, in an assembled state, the guide grooves are perpendicular to the front support frame and the rear support frame.

Preferably, the transverse scales and the vertical scale on each of the front support frame and the rear support frame are distributed in a T shape.

Preferably, the positioning hole is a square hole, a circular hole or a polygonal hole.

The banknote box according to the present application includes the above banknote size adjustment device.

In the banknote size adjustment device according to the present application, the banknotes are accommodated by a pair of assemblies, and the assemblies are positioned on the front support frame and the rear support frame by the latch plates, thus, by simply changing the installation positions of the assemblies by the latch plates, the size of the space for accommodating banknotes may be changed. That is, the size of the space for accommodating banknotes in the banknote box can be adjusted according to the size of the banknotes. One end of the latch plate is fixed to the compression spring, thus, by simply applying a small force, the compression spring can be further compressed to the unlocking position, and the latch plate may be pulled out of the positioning hole, so as to be moved to another positioning hole corresponding to an appropriate dimension. When the appropriate positioning hole is chosen and aligned, it only requires to release the latch plate, the compression spring can use its elastic force to insert the latch plate into the positioning hole. Therefore, the banknote size adjustment device according to the present application is time saving and labor saving, and since the position-limiting plate for carrying the banknotes has an L-shaped cross section and the two position-limiting plates cooperate to form a banknote accommodating space enclosed on three sides, when the latch plates are moved to move the assemblies, it equivalents to adjust both the length dimension and the width dimension of the space for receiving banknotes at the same time, thus both length dimension and width dimension of the space for accommodating the banknotes are adjusted at the same time.

DETAILED DESCRIPTION

Technical solutions of embodiments of the present application will be clearly and completely described hereinafter in conjunction with the drawings of the embodiments according to the present application. Apparently, the embodiments described are only some examples of the present application, rather than all embodiments. All other embodiments obtained by the person skilled in the art based on the embodiments of the present application without any creative efforts fall into the scope of protection of the present application.

Figure 1:
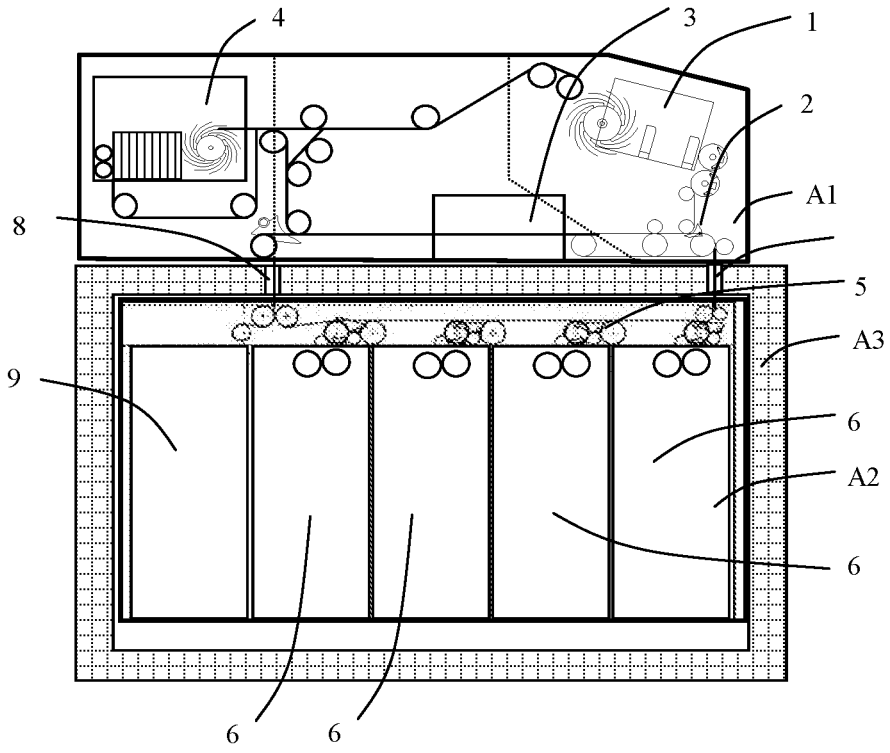
FIG. 1 is a schematic view showing the structure of a banknote processing device of an automatic banknote depositing and withdrawing machine equipped with this embodiment.

FIG. 1 is a schematic view showing the structure of a banknote processing device of an automatic banknote depositing and withdrawing machine. The automatic banknote depositing and withdrawing machine may be generally divided into an upper module A1, a lower module A2, and a cashbox A3, and the lower module A2 is arranged in the cashbox A3. The upper module mainly includes a banknote inlet/outlet 1, a banknote conveying passage 2, a banknote identifier 3, a temporarily storage region 4, and etc. The lower module mainly includes a lower conveying passage 5, a depositing banknote box 9, a cycling banknote box 6 and etc. The banknote size adjustment device according to the present application can be applied in the depositing banknote box 9 and/or the cycling banknote box 6.

A banknote box and a banknote size adjustment device thereof according to an embodiment of the present application are described hereinafter in conjunction with the drawings.

Figure 2:
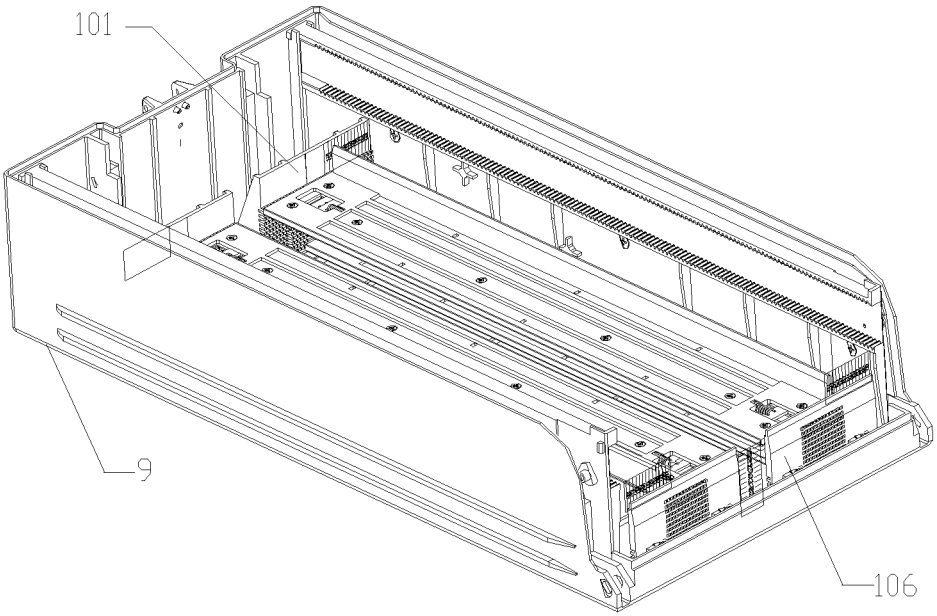
FIG. 2 is a schematic perspective view showing the structure of a banknote size adjustment device according to this embodiment installed in a banknote box.
Figure 3:
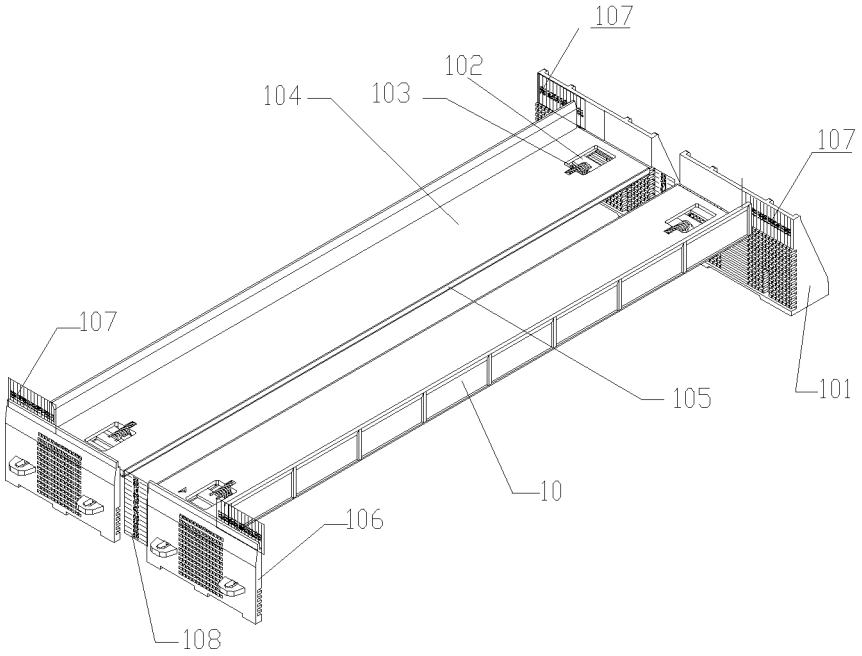
FIG. 3 is a schematic perspective view showing the structure of the banknote size adjustment device in FIG. 2.

Referring to FIGS. 2 and 3, the banknote size adjustment device is arranged in the banknote box 9, and the banknote size adjustment device includes a pair of assemblies 10 and a pair of support frames 101 and 106. The two assemblies 10 cooperate with each other to form a space for accommodating banknotes, and the pair of support frames may be divided into a front support frame 101 and a rear support frame 106. The front support frame 101 and the rear support frame 106 are respectively fixed to an inner front wall and an inner rear wall of the banknote box 9, and configured to support the pair of assemblies 10. Corresponding transverse scales 107 and corresponding longitudinal scales 108 are respectively provided on the pair of support frames, and multiple positioning holes corresponding to the scales 107 and 108 are provided in the pair of support frames, and the assemblies 10 are fixed in these positioning holes. The transverse scales 107 and the vertical scale 108 on each of the front support frame 101 and the rear support frame 106 are distributed to form a T shape. The transverse scales 107 respectively extend to two ends, and respectively provide a horizontal coordinate for movement of the two assemblies 10, and the longitudinal scales 108 provide a common vertical coordinate for movement of the two assemblies 10.

Figure 4:
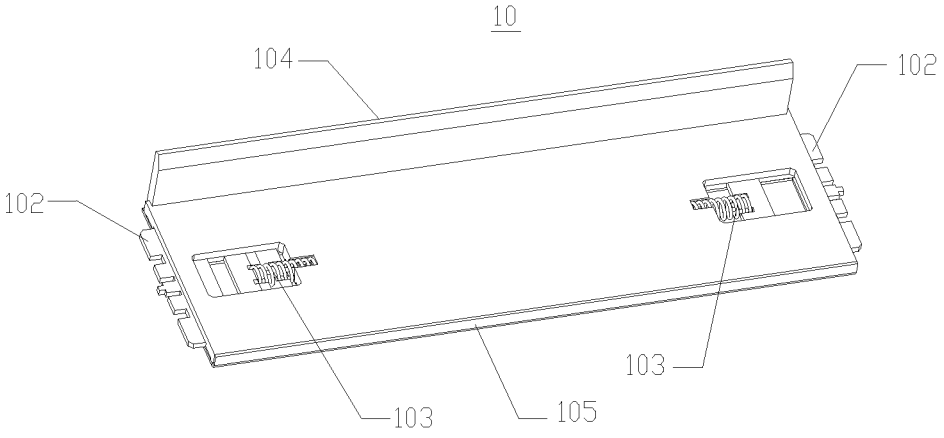
FIG. 4 is a schematic perspective view showing the structure of an assembly 10 in FIG. 3.

Referring to FIG. 4, each of the assemblies 10 includes a position-limiting plate 104, a reinforcing plate 105, a pair of latch plates 102 and a pair of compression springs 103. The reinforcing plate 105 is fixed to the bottom of the position-limiting plate 104. The two latch plates 102 are symmetrically arranged at ends of the position-limiting plate and the reinforcing plate, and the latch plated 102 are sandwiched between the position-limiting plate 104 and the reinforcing plate 105. The compression spring 103 has one end fixed to the reinforcing plate 105 and another end connected to one end of the latch plate 102, and is configured to apply an elastic force on the latch plate 102, to allow another end of the latch plate 102 to always maintain a tendency of being inserted into the positioning holes in the front support frame 101 and the rear support frame 106. By inserting the pair of latch plates 102 into the positioning holes, the assembly 10 is positioned on the front support frame 101 and the rear support frame 106. In addition, it is worth mentioning that, after the reinforcing plate 105 is fixed to the position-limiting plate 104, the reinforcing plate 105 can not only reinforce the strength of the position-limiting plate 104, but also limit the freedom of the latch plate 104 in an up-down direction. That is, the latch plate 102 is held between the position-limiting plate 104 and the reinforcing plate 105, and one end of the compression spring 103 is fixed to both the reinforcing plate 105 and the position-limiting plate 104, and the other end of the compression spring 103 is certainly connected to the latch plate 102. The compression spring 103 is in a compressed and energy storing state at both a locking position and an unlocking position shown in FIG. 5. When the latch plate 102 is in the unlocking position shown in FIG. 5, a front end of the compression spring may apply an elastic force to the latch plate 102 along a locking direction shown in FIG. 5, to allow the latch plate 102 to be inserted into the square positioning holes in the support frame 101 or 106 shown in FIG. 6. When the latch plate 102 is in the locking position shown in FIG. 5, the front end of the compression spring may still apply an elastic force to the latch plate 102 along the locking direction shown in FIG. 5, to allow the latch plate 102 to be reliably fixed to the support frames 101 and 106.

As illustrated in FIGS. 3 and 4, the position-limiting plate 104 includes a bottom surface and a side surface which are substantially perpendicular to each other, and thus is in a shape of character L when seen from the cross section. In assembling, the pair of assemblies 10 are arranged to face each other, and the two position-limiting plates facing each other form a space enclosed on three sides for accommodating banknotes. By adjusting the distance between the two assemblies 10, the length of the space for accommodating the banknotes can be adjusted.

Figure 8:
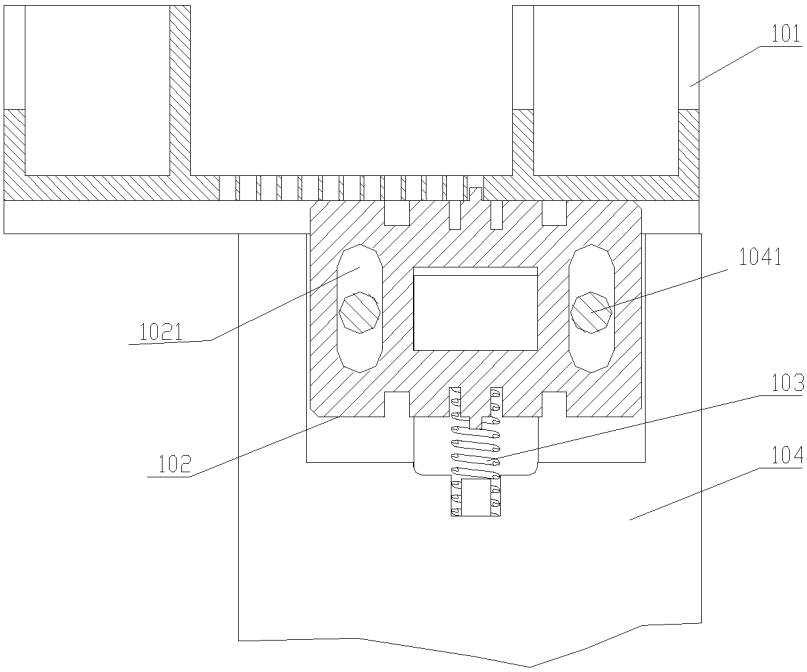
FIG. 8 is a detailed schematic view showing that a latch plate is locked with respect to the support frame, and showing a positional relationship among the latch plate, a compression spring and the position-limiting plate.

Referring to FIG. 8, the latch plate 102 is provided with a pair of guide grooves 1021, and the position-limiting plate 104 or the reinforcing plate 105 is provided with a pair of guide cylinders 1041 corresponding to the guide grooves 1021. The two guide cylinders 1041 extend into the two guide grooves 1021 respectively, and are configured to limit an inserting-withdrawing direction of the latch plates 102. In an assembled state, the guide groove 1021 is perpendicular to the front support frame 101 and the rear support frame 106. That is, the inserting-withdrawing direction of the latch plate 102 is perpendicular to the support frames 101 and 106, to allow the latch plate 102 to be inserted into or withdrawn from the support frames 102 and 106, thereby realizing the assembling and disassembling of the assemblies 10 with respect to the support frames 101 and 106. Thus, the position of the assemblies 10 can be moved, thus achieving the adjustment of the size of the space for accommodating the banknotes, that is, the size of the space for accommodating the banknotes can be adjusted according to the size of the banknotes.

Figure 5:
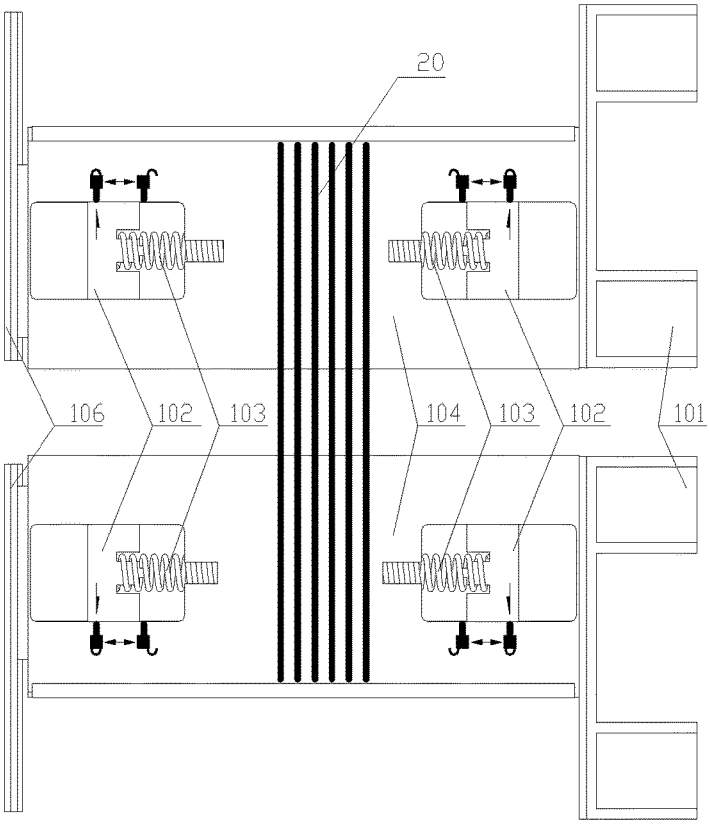
FIG. 5 is a top view of a banknote size adjustment device adjusting according to a length dimension and a width dimension of banknotes in the banknote box.
Figure 6:
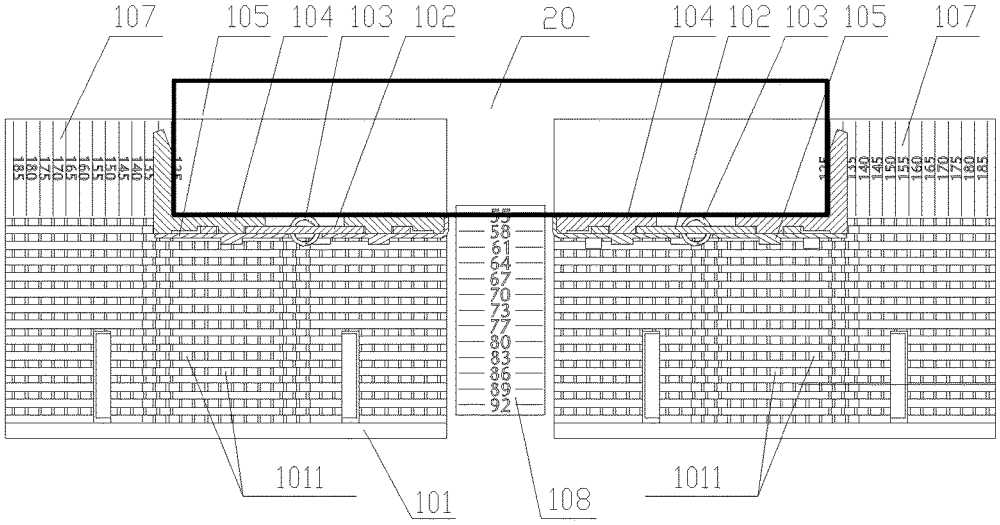
FIG. 6 is a diagram showing the positional relationship between a position-limiting plate and a support frame.

A method for adjusting the size of the space for accommodating banknotes by the banknote size adjustment device according to this embodiment is described in conjunction with the drawings. As shown in FIG. 5, the latch plate 102 are fixed between the position-limiting plate 104 and the reinforcing plate 105 for the position-limiting plate, and can be moved along the locking direction and the unlocking direction as shown in FIG. 5. When it is required to adjust the size, the latch plates 102 are moved to the unlocking position shown in FIG. 5, and after the size adjustment is finished, the latch plates 102 are released, thus the latch plates 102 may automatically protrude into the square positioning holes in the support frame 101 and 106 under the action of the compression springs 103, and details of the square positioning holes 1011 in the support frame 101 are shown in FIG. 6. The position-limiting plate 104 is used to adjust both the length dimension and the width dimension of the banknote box adapted to the banknotes, and the position-limiting plate 104 is fixed to the support frames 101 and 106 for the position-limiting plate by the latch plates 102. In installing this device, the support frames 101 and 106 are fixed in the banknote box first, and then the assemblies 10 are fixed to the support frames 101 and 106 by the latch plates 102, thus a space enclosed on three sides for accommodating banknotes is formed inside the banknote box. In the case that an adjustment according to the size specification of banknotes is performed by a conventional banknote size adjustment device, it generally requires to loosen screws in the support frames to shift the position of the support frames, and then separately adjust a length position limiter and a width position limiter, to finish the size adjustment. When the size adjustment is finished, it further requires to tighten the screws, the adjustment is difficult and the operation process is cumbersome. For the banknote box provided with the banknote size adjustment device according to the embodiment of the present application, it simply requires to press the latch plates 102 inwards and then move the assemblies 10, and both the length dimension and the width dimension may be adjusted. After the adjustment is finished, it only requires to release the latch plates 102, and they can be automatically inserted into the square positioning holes in the support frames 101 and 106. The positioning holes in this embodiment are described as square holes, which is a preferable embodiment of the present application, and it should be noted that, the above preferable embodiment should not be deemed as a limitation to the present application, positioning holes of other forms such as circular holes, polygonal holes, or holes having other shapes are also feasible.

Reference is made to FIGS. 5 and 6, which are simple views of the banknote size adjustment device according to this embodiment. The placement of banknotes 20 in this device is shown in FIGS. 5 and 6. When the banknotes 20 have different denominations, the outline sizes of the banknotes are also different. When placing banknotes into the banknote box, it is required to adjust the position-limiting plate to be adapted to the banknotes with the different sizes. As shown in FIGS. 5 and 6, the latch plates 102, the position-limiting plate 104, the reinforcing plate 105 and the compression springs 103 in this device form one assembly 10. When it is required to adjust the device according to the specification and size of banknotes, it simply requires to shift the position of the assemblies 10, and the length dimension and the width dimension may just be adjusted at the same time, and then it only requires to insert the latch plates into the square positioning holes in the support frame 101 (or 106). When it is required to change the space in the banknote box according to the banknote specification, it simply requires an operator to press each of the latch plates 102 inwards to a position where the latch plate can be unlocked, the assemblies 10 may be separated from the support frames 101 and 106; and then the operator may move the assemblies 10 to a position according to the required banknote size and specification with reference to the scales 107 and 108, and then release the latch plates 102, thus the latch plates 102 are automatically locked in the square positioning holes in the support frames 101 and 106 by the compression springs 103. Lastly, it requires to check whether an indicating arrow on each of the latch plates 102 is aligned with the locking position, if the indicating arrow is not aligned with the locking position, it indicates that the latch plate 102 is not correctly inserted into the square positioning holes of the support frame 101 and 106, and in this case, it simply requires to slightly adjust the latch plate 102 to correctly insert the latch plate 102 into the square positioning hole, to allow the indicating arrow to be aligned with the locking position. At this point, the adjustment to the length dimension and the width dimension of the banknote box is finished.

Figure 7:
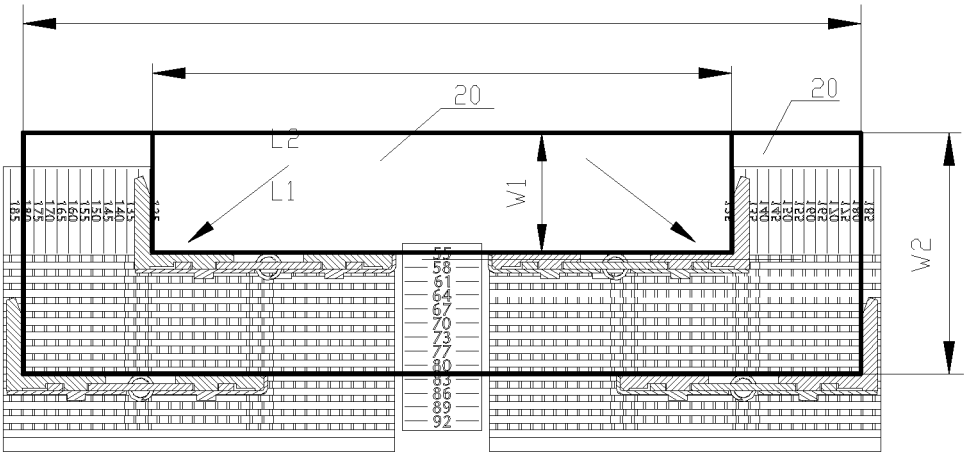
FIG. 7 is a schematic view showing moving directions of the assembly 10 in size adjustment.

FIG. 7 is a schematic view showing the movement of the assemblies 10 when adjusting the size. When it is required to adjust the size of the space for accommodating the banknotes from L1×W1 to L2×W2, it simply requires to release the latch plates in the manner described in the previous paragraph, and then move the pair of assemblies 10 along the directions in the drawings to the required size of L2×W2, and then release the latch plates, thus the size adjustment is accomplished. When it is required to adjust the size from L2×W2 to L1×W1, the operation can be performed in the same manner except that the moving direction of the assemblies A are opposite to the directions in the drawings.

Figure 9:
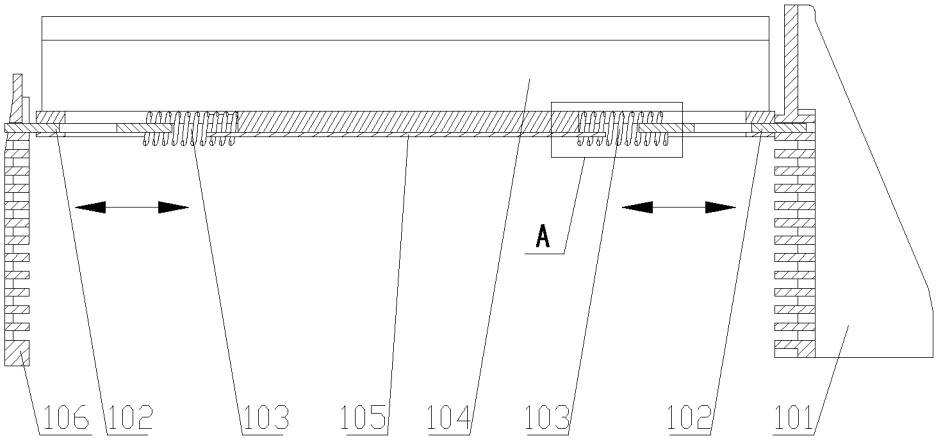
FIG. 9 is a schematic longitudinal sectional view showing the structure of the banknote size adjustment device taken along the installation position of the compression spring.

Further, as shown in FIGS. 8 and 9, the support frames 101 or 106 are fixed in the banknote box in assembling the banknote box, and square positioning holes corresponding to various sizes have been machined in the support frames. When it is required to adjust the size of the space for accommodating the banknotes, the latch plates 102 are pressed inwards to the unlock positions (referring to FIG. 5), to disengage the assemblies 10 from the support frames 101 and 106. When the size adjustment is finished, the latch plates 102 are released, the latch plates 102 may be automatically inserted into the square positioning holes in the support frames 101 and 106 for the position-limiting plates under the action of the elastic force of the compression springs 103, and the latch plates are moved to the locking positions (referring to FIG. 5) respectively to fix the position of the assemblies 10.

In a conventional banknote size adjustment device for a banknote box, the length position limiter and the width position limiter are separated, therefore, when changing the size or specification of the space for accommodating the banknotes, it requires to loosen the fixing screws to separately adjust the length position limiter and the width position limiter. When the adjustment is finished, it further requires to fasten the fixing screws to realize the positioning, the operation is obviously complicated. For the banknote size adjustment device according to the present application, when it is required to adjust the size and specification of the space for accommodating the banknotes, it is simply required to shift the position of the assemblies 10, both the length dimension and the width dimension may be adjusted at the same time, and then it only requires to insert the latch plates 102 into the square positioning holes in the support frame 101 (or 106), the size adjustment is thus finished. The operation is simple, time-saving and labor-saving.

The above embodiments are only preferable embodiments of the present application and are not intended to limit the scope of protection of the present application. Any equivalent variations made based on the specification and drawings of the present application should be deemed to fall into the scope of protection of the present application.

What is claimed is:

1. A banknote size adjustment device, configured to be arranged in a banknote box, the banknote size adjustment comprising:

a pair of assemblies cooperating with each other to form a space for accommodating banknotes, a size of the space for accommodating banknotes being adjustable; and a front support frame and a rear support frame, wherein corresponding transverse scales and corresponding longitudinal scales are provided on the front support frame and the rear support frame, and a plurality of positioning holes corresponding to the transverse scales and the longitudinal scales are provided in the front support frame and the rear support frame, the front support frame and the rear support frame are configured to be fixed to an inner front wall and an inner rear wall of the banknote box respectively and configured to support the pair of assemblies;

wherein each of the assemblies comprises a position-limiting plate, a reinforcing plate, a pair of latch plates and a pair of compression springs, the reinforcing plate is fixed to a bottom of the position-limiting plate, and one of the latch plates is arranged at one end of the position-limiting plate and the reinforcing plate and is sandwiched between the position-limiting plate and the reinforcing plate, one of the compression springs has one end fixed to the reinforcing plate or the position-limiting plate and another end connected to one end of the one of the latch plates, and is configured to apply an elastic force to the one of the latch plates, to allow another end of the one of the latch plates to always maintain a tendency of being inserted into the positioning holes, and the other one of the latch plates is arranged at another end of the position-limiting plate and the reinforcing plate symmetrically with respect to the one of the latch plates, and the other one of the compression springs is arranged at the another end of the position-limiting plate and the reinforcing plate symmetrically with respect to the one of the compression springs, and the assembly is positioned on the front support frame and the rear support frame by the pair of latch plates.

2. The banknote size adjustment device according to claim 1, wherein the position-limiting plate has an L-shaped cross section, and the pair of assemblies are arranged to face each other, and the two position-limiting plates face each other to form a space enclosed on three sides for accommodating banknotes.

3. The banknote size adjustment device according to claim 1, wherein each of the latch plates is provided with a pair of guide grooves, and the position-limiting plate or the reinforcing plate is provided with a pair of guide cylinders corresponding to the guide grooves, and the pair of guide cylinders protrude into the pair of guide grooves respectively, to limit an inserting-withdrawing direction of the latch plate.

4. The banknote size adjustment device according to claim 3, wherein in an assembled state, the guide grooves are perpendicular to the front support frame and the rear support frame.

5. The banknote size adjustment device according to claim 1, wherein the transverse scales and the vertical scale on each of the front support frame and the rear support frame are distributed in a T shape.

6. The banknote size adjustment device according to claim 1, wherein the positioning hole is a square hole, a circular hole or a polygonal hole.

7. A banknote box, comprising the banknote size adjustment device according to claim 1.

8. The banknote box according to claim 7, wherein the position-limiting plate has an L-shaped cross section, and the pair of assemblies are arranged to face each other, and the two position-limiting plates face each other to form a space enclosed on three sides for accommodating banknotes.

9. The banknote box according to claim 7, wherein each of the latch plates is provided with a pair of guide grooves, and the position-limiting plate or the reinforcing plate is provided with a pair of guide cylinders corresponding to the guide grooves, and the pair of guide cylinders protrude into the pair of guide grooves respectively, to limit an inserting-withdrawing direction of the latch plate.

10. The banknote box according to claim 9, wherein in an assembled state, the guide grooves are perpendicular to the front support frame and the rear support frame.

11. The banknote box according to claim 7, wherein the transverse scales and the vertical scale on each of the front support frame and the rear support frame are distributed in a T shape.

12. The banknote box according to claim 7, wherein the positioning hole is a square hole, a circular hole or a polygonal hole.

* * * * *